US009905903B2

(12) United States Patent
Kwak et al.

(10) Patent No.: US 9,905,903 B2
(45) Date of Patent: Feb. 27, 2018

(54) RESONATOR FILTER HAVING A ROTATABLE ROD THAT PRESSES A DIELECTRIC MATERIAL INTO AN ELASTIC SPRING MATERIAL

(71) Applicant: Electronics and Telecommunications Research Institute, Daejeon (KR)

(72) Inventors: Changsoo Kwak, Daejeon (KR); Man Seok Uhm, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 120 days.

(21) Appl. No.: 14/990,287

(22) Filed: Jan. 7, 2016

(65) Prior Publication Data

US 2016/0294030 A1 Oct. 6, 2016

(30) Foreign Application Priority Data

Apr. 2, 2015 (KR) ..... 10-2015-0047096

(51) Int. Cl.
*H01P 7/10* (2006.01)
*H01P 1/208* (2006.01)
*H01P 7/04* (2006.01)

(52) U.S. Cl.
CPC ..... *H01P 7/10* (2013.01); *H01P 1/2084* (2013.01); *H01P 7/04* (2013.01)

(58) Field of Classification Search
CPC ..... H01P 1/2084; H01P 7/10
USPC ..... 333/202, 219.1, 235
See application file for complete search history.

(56) References Cited

U.S. PATENT DOCUMENTS

| | | | | |
|---|---|---|---|---|
| 3,943,417 | A | 3/1976 | Patti | |
| 5,886,986 | A | 3/1999 | Lee et al. | |
| 6,060,965 | A | 5/2000 | Sung et al. | |
| 6,535,086 | B1 * | 3/2003 | Liang et al. | H01P 1/205 333/219.1 |
| 6,600,394 | B1 * | 7/2003 | Wang et al. | H01P 7/10 333/231 |
| 7,075,392 | B2 | 7/2006 | Smith et al. | |
| 7,486,162 | B2 | 2/2009 | Weitzenberger et al. | |
| 2003/0137300 | A1 | 7/2003 | Gonella et al. | |
| 2005/0030131 | A1 * | 2/2005 | Yamakawa et al. | H01P 7/10 333/202 |
| 2010/0308937 | A1 * | 12/2010 | Myllyvainio et al. | H01P 7/10 333/202 |

(Continued)

FOREIGN PATENT DOCUMENTS

EP 1329916 B1 5/2008

*Primary Examiner* — Benny Lee
(74) *Attorney, Agent, or Firm* — William Park & Associates Ltd.

(57) ABSTRACT

A resonator filter according to a first exemplary embodiment of the present invention includes: a cover formed with a first coupling hole; a housing connected to the cover to form an inner space and having a second coupling hole formed at a bottom of the inner space; a dielectric material mounted around the second coupling hole in the bottom of the inner space of the housing; a first rod inserted to the first coupling hole to be connected to the cover and pressing the dielectric material; and a second rod inserted to the second coupling hole to be connected to the housing to be close to the dielectric material and tuning a resonance frequency by controlling a separation distance from the first rod.

14 Claims, 4 Drawing Sheets

(56) References Cited

U.S. PATENT DOCUMENTS

2011/0128097 A1* 6/2011 Park et al. ..... H01P 7/10
333/219.1

* cited by examiner

RESONATOR FILTER HAVING A ROTATABLE ROD THAT PRESSES A DIELECTRIC MATERIAL INTO AN ELASTIC SPRING MATERIAL

CROSS-REFERENCE TO RELATED APPLICATION

This application claims priority to and the benefit of Korean Patent Application No. 10-2015-0047096 filed in the Korean Intellectual Property Office on Apr. 2, 2015, the entire contents of which are incorporated herein by reference.

BACKGROUND OF THE INVENTION (a) Field of the Invention

The present invention relates a microwave filter, and in detail, relates to a resonator filter using a dielectric material.

(b) Description of the Related Art

A microwave filter selecting a desired frequency band determines performance of a wireless telecommunications system. Especially, when the communications system uses many channels, the size and cost reduction of the filter is very important because the same number of filters as the number of channels are used.

As the filter used in the wireless communications system, there are filters using a lumped element, a micro-strip or a strip line filter using a transmission line, a resonator filter, a wave guide filter, and a SAW (surface acoustic wave) filter and so forth.

Among the various filters as described above, the cavity resonator filter loaded by dielectric material shows a high quality factor, and its mass and volume are relatively small compared with cavity filters without dielectric material.

The cavity resonator filter must have an appropriate number of resonators and a required connectivity to realize a preferable frequency response characteristic. In general, since the number of resonators constituting the filter must be high to realize a filter with a sharp roll-off rejection characteristic, the size of the filter gets large. Accordingly, to provide a small-size filter, methods of reducing the size of the resonator itself and the number of resonators have been undertaken by using a cavity resonator of a dual mode or a triple mode in which several resonance modes are realized in one cavity.

As high quality wireless system performance is required, a filter having stringent performance has been required. However, as the frequency response characteristic is very sensitive errors can occur when realizing the filter, such as distortion of the frequency characteristic due to a design error or a manufacturing error directly affects the performance of the filter. Therefore, there is a case that the performance requirements of the filter are not satisfied due to a small error.

The above information disclosed in this Background section is only for enhancement of understanding of the background of the invention and therefore it may contain information that does not form the prior art that is already known in this country to a person of ordinary skill in the art.

SUMMARY OF THE INVENTION

An exemplary embodiment of the present invention provides a resonator filter reducing the size of the filter and simultaneously easily controlling the resonance frequency of the filter.

A resonator filter according to a first exemplary embodiment of the present invention includes: a cover formed with a first coupling hole; a housing connected to the cover to form an inner space and having a second coupling hole formed at a bottom of the inner space; a dielectric material mounted around the second coupling hole in the bottom of the inner space of the housing; a first rod inserted to the first coupling hole to be connected to the cover and pressing the dielectric material; and a second rod inserted to the second coupling hole to be connected to the housing to be close to the dielectric material and tuning a resonance frequency by controlling a separation distance from the first rod.

The first coupling hole and the first rod may be screw-coupled.

The first rod may have a coupling groove to allow a rotary tool to rotate the first rod.

The dielectric material may be formed with a hollow portion to be penetrated by the second rod.

The first rod may include an adhesive member to be fixed to the first coupling hole.

The second coupling hole and the second rod may be connected by screw-coupling.

The second rod may include a fixing nut close to the housing outside and fixing an insertion length of the second rod.

The dielectric material may include an elastic member within the housing.

The housing may include a mounting groove mounted with the dielectric material at the bottom thereof.

A resonator filter according to a second exemplary embodiment of the present invention includes: a cover formed with a first coupling hole; a housing connected under the cover and forming a space that is enclosed; a dielectric material positioned at a bottom of the housing inner space; a first rod inserted to the first coupling hole of the cover, pressing the dielectric material, and formed with a hollow portion; and a second rod inserted to the hollow portion of the first rod, close to the dielectric material, and controlling a separation distance from the housing bottom to tune a resonance frequency.

The first coupling hole and the first rod may be connected by screw-coupling.

The dielectric material may be formed with the hollow portion to be penetrated with the second rod.

The dielectric material may include an elastic member within the housing.

The housing may include a mounting groove mounted with the dielectric material at the bottom thereof.

A fixing nut fixing an insertion length of the second rod between the first rod and the second rod may be further included.

The first rod may include an adhesive member at the cover.

In the resonator filter according to the present exemplary embodiments, the first rod and the dielectric material are contacted with each other, and when thermal deformation due to a temperature change is generated, damage to the dielectric material due to the thermal deformation may be prevented by the elastic member capable of absorbing the thermal deformation.

Also, the size of the resonator filter may be reduced and simultaneously the resonance frequency of the filter may be easily controlled.

DETAILED DESCRIPTION OF THE EMBODIMENTS

Figure 1:
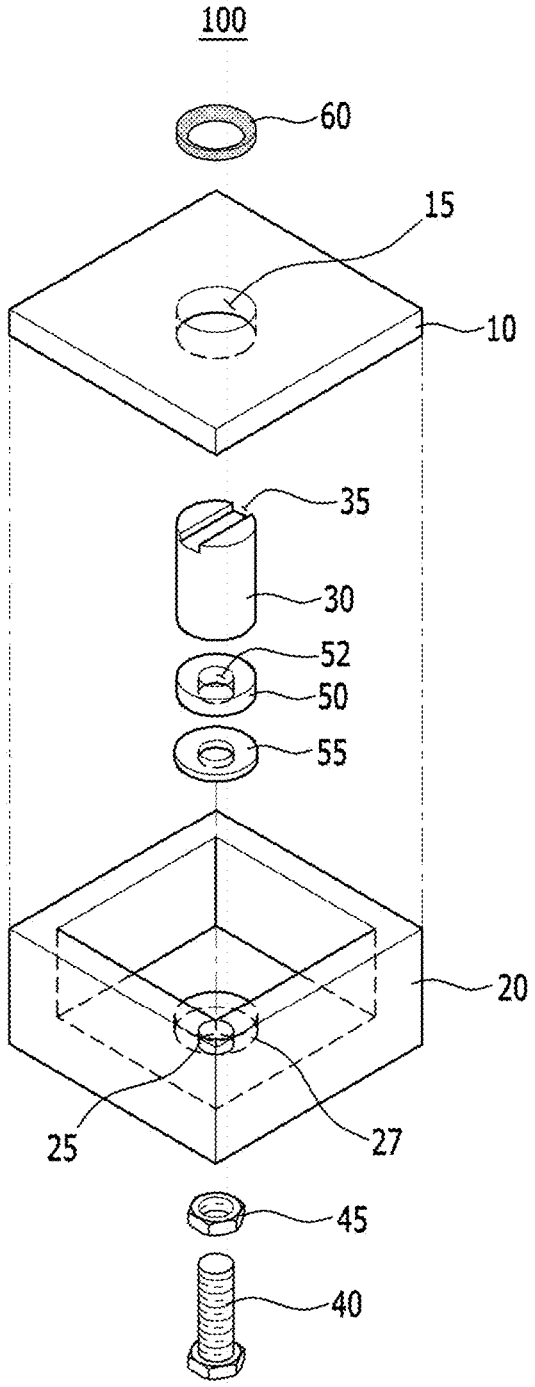
FIG. 1 is a perspective exploded view of a resonator filter according to a first exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Parts unrelated to the description of the exemplary embodiments are not shown to make the description clear, and like reference numerals designate like element throughout the specification.

The size and thickness of the configurations are optionally shown in the drawings for convenience of description, and the present invention is not limited to the drawings.

In addition, unless explicitly described to the contrary, the word "comprise" and variations such as "comprises" or "comprising" will be understood to imply the inclusion of stated elements but not the exclusion of any other elements.

Figure 2:
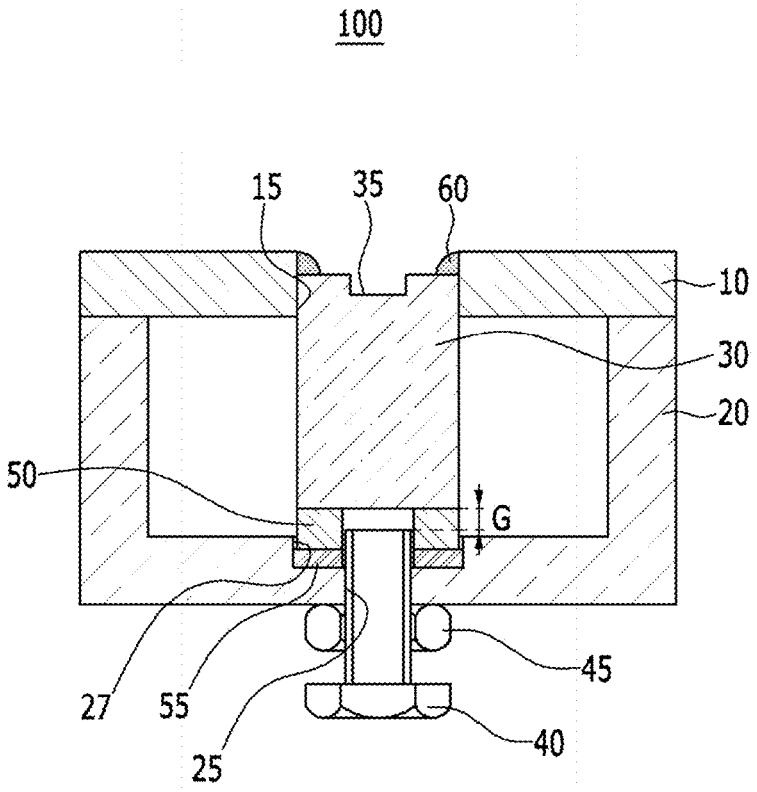
FIG. 2 is a cross-sectional view of a resonator filter according to a first exemplary embodiment of the present invention.

FIG. 1 is a perspective exploded view of a resonator filter according to a first exemplary embodiment of the present invention, and FIG. 2 is a cross-sectional view of a resonator filter according to a first exemplary embodiment of the present invention.

Referring to FIG. 1 and FIG. 2, in a resonator filter 100 according to the present first exemplary embodiment, a housing 20 formed with a second coupling hole 25 is connected to a cover 10 formed with a first coupling hole 15, and a dielectric material 50 is positioned inside the housing 20. A first rod 30 for pressing the dielectric material 50 is connected to the cover 10, and a second rod 40 is connected to the housing 20.

The first coupling hole 15 is formed in the cover 10 and the first rod 30 is coupled to the first coupling hole 15. The position of the first coupling hole 15 may be in one line with the dielectric material 50. A thread may be formed in an interior circumference of the first coupling hole 15. Accordingly, the first rod 30 may be connected to the first coupling hole 15 by screw-coupling. The first rod 30 may further include a rotary tool coupling groove 35 so that the rotation is easily performed by a rotary tool such as a driver.

The housing 20 formed with the second coupling hole 25 connected under the cover 10. The position of the second coupling hole 25 may be in one line with the first coupling hole 15. The thread may be formed in an interior circumference of the second coupling hole 25. Accordingly, the second rod 40 may be connected to the second coupling hole 25 by the screw-coupling. The second rod 40 may have a bolt shape.

The dielectric material 50 is positioned inside the housing 20. The dielectric material 50 has a larger diameter than the second coupling hole and may be mounted in the second coupling hole 25. A hollow portion 52 (FIG. 1) may be formed in the dielectric material 50 to be circular. The dielectric material 50 may be positioned with a segmented shape around the second rod 40. Accordingly, the second rod 40 may be connected to be close to the dielectric material 50. The second rod 40 may communicate with the hollow portion 52 of the dielectric material 50. In this case, the second rod 40 penetrates the dielectric material 50 and may control a separation distance G (FIG. 2) from the first rod 30 in the dielectric material 50. Capacitance is determined depending on a length between the second rod 40 and the separation distance G of the first rod 30. A user may tune the required resonance frequency by increasing or decreasing the separation distance G with the first rod 30 while rotating the second rod 40. A fixing nut 45 fixing the insertion length of the second rod 40 when the tuning of the resonance frequency is completed may be further included. The fixing nut 45 is installed outside the housing 20.

The first rod 30 presses the dielectric material 50 to fix the dielectric material 50. The first rod 30 may be cylindrical of which a center is empty to reduce the weight thereof.

An elastic member 55 may be positioned between the dielectric material 50 and the housing 20. The elastic member 55 may have the same shape as the dielectric material 50. The elastic member 55 has a function of alleviating thermal stress generated by a thermal expansion difference between the dielectric material and other parts when the dielectric material 50 is pressed by the first rod 30 or when thermal deformation is generated. The elastic member 55 may be a spring.

The housing 20 may further include a mounting groove 27 that is mounted and coupled to be inserted with the dielectric material 50 at a bottom thereof. By forming the mounting groove 27 at the bottom of the housing 20, the dielectric material 50 may be prevented from being moved inside the housing 20 and the entire height of the filter may be reduced, and the dielectric material 50 is inserted to the mounting groove 27 along with the elastic member 55, thereby assembly may be easy.

Figure 3:
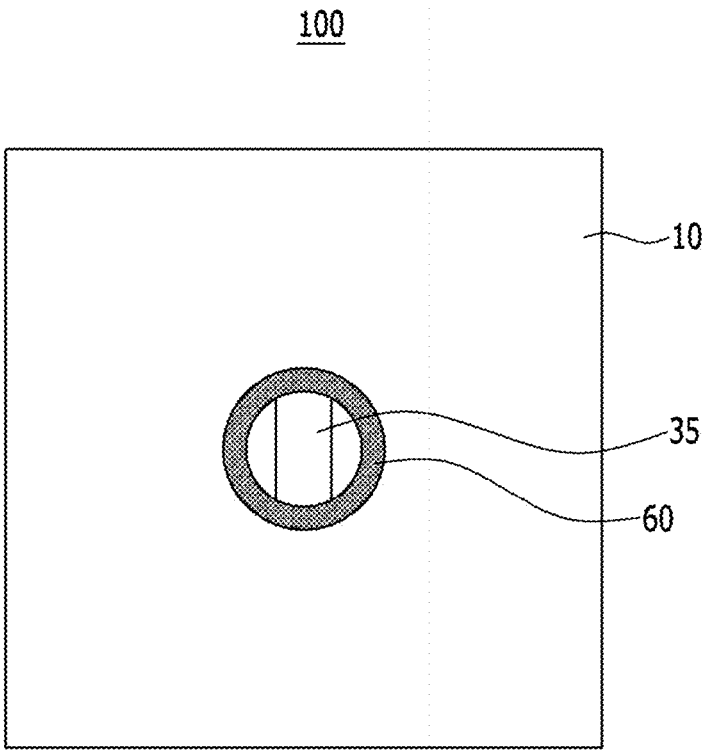
FIG. 3 is a top plan view of a resonator filter according to a first exemplary embodiment of the present invention.

FIG. 3 is a top plan view of a resonator filter according to a first exemplary embodiment of the present invention.

Referring to FIG. 3, an adhesive member 60 is further included between the first coupling hole 15 (FIGS. 1 and 2) formed in the cover 10 and the first rod 30 (FIGS. 1 and 2). If the first rod 30 contacts the dielectric material 50 to determine the insertion length, the first rod 30 is adhered to the first coupling hole 15 by the adhesive member 60. Accordingly, the first rod 30 cannot be moved such that the insertion length of the first rod 30 inserted to the housing 20 may be prevented from being changed. The adhesive member 60 may be made of welding.

Figure 4:
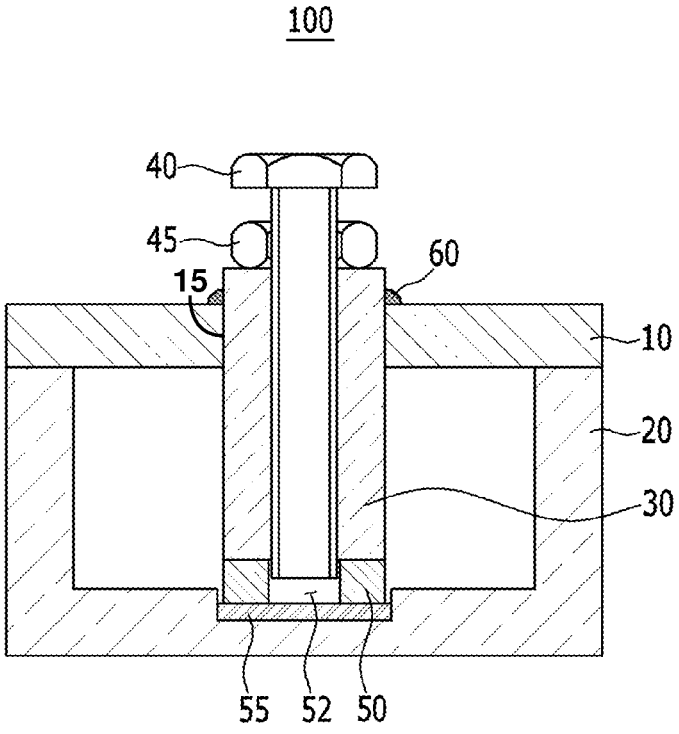
FIG. 4 is a cross-sectional view of a resonator filter according to a second exemplary embodiment of the present invention.

FIG. 4 is a cross-sectional view of a resonator filter according to a second exemplary embodiment of the present invention.

Referring to FIG. 4, the housing 20 is connected to the cover 10 formed with the first coupling hole 15, and the dielectric material 50 is disposed inside the housing 20. The first rod 30 is formed with the hollow portion and may be connected to the first coupling hole 15. The second rod 40 is inserted to the hollow portion of the first rod 30 and penetrates the dielectric material 50, thereby controlling the separation distance G (FIG. 2) from the housing bottom.

The first rod 30 formed with the hollow portion in the center is connected to the first coupling hole 15. The adhesive member 60 fixing between the first rod 30 may be further included in the first coupling hole 15.

The second rod 40 is inserted in the hollow portion of the first rod 30 to be connected. The second rod 40 and the first rod 30 may be screw-coupled. When the insertion length of the second rod 40 is determined between the second rod 40 and the first rod 30, the fixing nut 45 fixing the length may be installed.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

<Description of symbols>

| | |
|---|---|
| 100: resonator filter | 10: cover |
| 15: first coupling hole | 20: housing |
| 25: second coupling hole | 27: mounting groove |
| 30: first rod | 35: coupling groove |
| 40: second rod | 45: fixing nut |
| 50: dielectric material | 52: hollow portion |
| 55: elastic member | 60: adhesive member |
| G: separation distance | |

What is claimed is:

1. A resonator filter comprising:

a cover formed with a first coupling hole;

a housing connected to the cover to form an inner space and having a second coupling hole formed at a bottom of the inner space;

a dielectric material mounted within the inner space of the housing;

an elastic spring material mounted between the dielectric material and the housing;

a first rod inserted into the first coupling hole to be connected to the cover and pressing the dielectric material; and a second rod inserted into the second coupling hole to be connected to the housing to be close to the dielectric material and tuning a resonance frequency by controlling a separation distance from the first rod, wherein both the first rod and the second rod are rotatable such that both the rotating of the first rod that presses the dielectric material into the elastic spring material and the rotating of the second rod that controls the separation distance between an end of the first rod and an end of the second rod provides the resonance frequency tuning.

2. The resonator filter of claim 1, wherein the first coupling hole and the first rod are screw-coupled.

3. The resonator filter of claim 1, wherein the first rod has a coupling groove to be coupled to a rotary tool.

4. The resonator filter of claim 1, wherein the dielectric material is formed with a hollow portion to be penetrated by the second rod.

5. The resonator filter of claim 1, wherein the first rod includes an adhesive member that is fixed to the first coupling hole.

6. The resonator filter of claim 1, wherein the second coupling hole and the second rod are connected by screw-coupling.

7. The resonator filter of claim 1, wherein the second rod includes a fixing nut close to the housing outside and fixing an insertion length of the second rod.

8. The resonator filter of claim 1, wherein the housing includes a mounting groove mounted with the dielectric material at the bottom thereof.

9. A resonator filter comprising:

a cover formed with a first coupling hole;

a housing connected to the cover to form an inner space and having a second coupling hole formed at a bottom of the inner space;

a dielectric material mounted within the inner space of the housing;

a first rod inserted into the first coupling hole to be connected to the cover and pressing the dielectric material; and a second rod inserted into the second coupling hole to be connected to the housing to be close to the dielectric material and tuning a resonance frequency by controlling a separation distance from the first rod, wherein the first rod includes an adhesive member disposed at the cover.

10. A resonator filter comprising:

a cover formed with a first coupling hole;

a housing connected under the cover and forming a space that is enclosed;

a dielectric material positioned within the space that is enclosed;

an elastic spring material mounted between the dielectric material and an inner lower wall of the housing;

a first rod inserted into the first coupling hole of the cover, pressing the dielectric material, and formed with a hollow portion; and a second rod inserted into the hollow portion of the first rod, close to the dielectric material, and controlling a separation distance from the housing bottom to tune a resonance frequency, wherein both the first rod and the second rod are rotatable such that both a rotating of the first rod that presses the dielectric material into the elastic spring material and a rotating of the second rod that controls a separation distance between an end of the first rod and an end of the second rod provides the resonance frequency tuning.

11. The resonator filter of claim 10, wherein the first coupling hole and the first rod are connected by screw-coupling.

12. The resonator filter of claim 10, wherein the dielectric material is also formed with a hollow portion to be penetrated by the second rod.

13. The resonator filter of claim 10, further comprising a fixing nut fixing an insertion length of the second rod between the first rod and the second rod.

14. The resonator filter of claim 10, wherein the housing includes a mounting groove mounted with the dielectric material at the bottom thereof.

* * * * *